US006100872A

United States Patent [19]

Aratani et al.

[11] Patent Number: 6,100,872

[45] **Date of Patent: *Aug. 8, 2000**

[54] DISPLAY CONTROL METHOD AND APPARATUS

[75] Inventors: Shuntaro Aratani, Machida; Kazumi Suga, Tokyo, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/917,938

[22] Filed: Aug. 27, 1997

Related U.S. Application Data

[63] Continuation of application No. 08/248,511, May 24, 1994, abandoned.

[30] Foreign Application Priority Data

May 25, 1993 [JP] Japan ..... 5-122500

[51] Int. Cl.[7] ..... G09G 3/00

[52] U.S. Cl. ..... 345/147; 345/89; 345/97; 358/456

[58] Field of Search ..... 345/147, 155, 345/153, 89, 186, 97, 173, 175, 204, 103, 507; 348/446, 671; 358/429, 455, 456, 457, 458, 460

[56] References Cited

U.S. PATENT DOCUMENTS

| | | | |
|---|---|---|---|
| 4,538,184 | 8/1985 | Otsuka et al. | 358/460 |
| 4,733,230 | 3/1988 | Kurihara et al. | 345/150 |
| 4,782,328 | 11/1988 | Denlinger | 345/175 |
| 5,254,982 | 10/1993 | Feigenblatt et al. | 345/89 |
| 5,321,419 | 6/1994 | Katakura et al. | 345/97 |
| 5,450,098 | 9/1995 | Oz | 345/199 |
| 5,483,634 | 1/1996 | Hasegawa | 345/147 |
| 5,701,135 | 12/1997 | Aratani et al. | 345/89 |

*Primary Examiner*—Lun-Yi Lao
*Attorney, Agent, or Firm*—Fitzpatrick, Cella, Harper & Scinto

[57] ABSTRACT

A display control method and apparatus for quantizes input data to binary or multivalued data and delivers the quantized data to a display device such as a matrix panel display. When input data is quantized as by the error-diffusion method and displayed, an area in which there is no change in the display is scanned by multi-interlacing, whereas an area in which there is a change in the display is scanned preferentially and in interlaced fashion. As a result, a flicker-free image having a high picture quality can be displayed at high speed. Further, error produced by the error-diffusion method is reset at a prescribed line and, at the time of the error resetting operation, error-diffusion processing is executed from a line located several lines earlier, thereby preventing the occurrence of sparkling noise and making it possible to display an image of a high picture quality in which the continuity of error-diffusion processing is maintained.

20 Claims, 14 Drawing Sheets

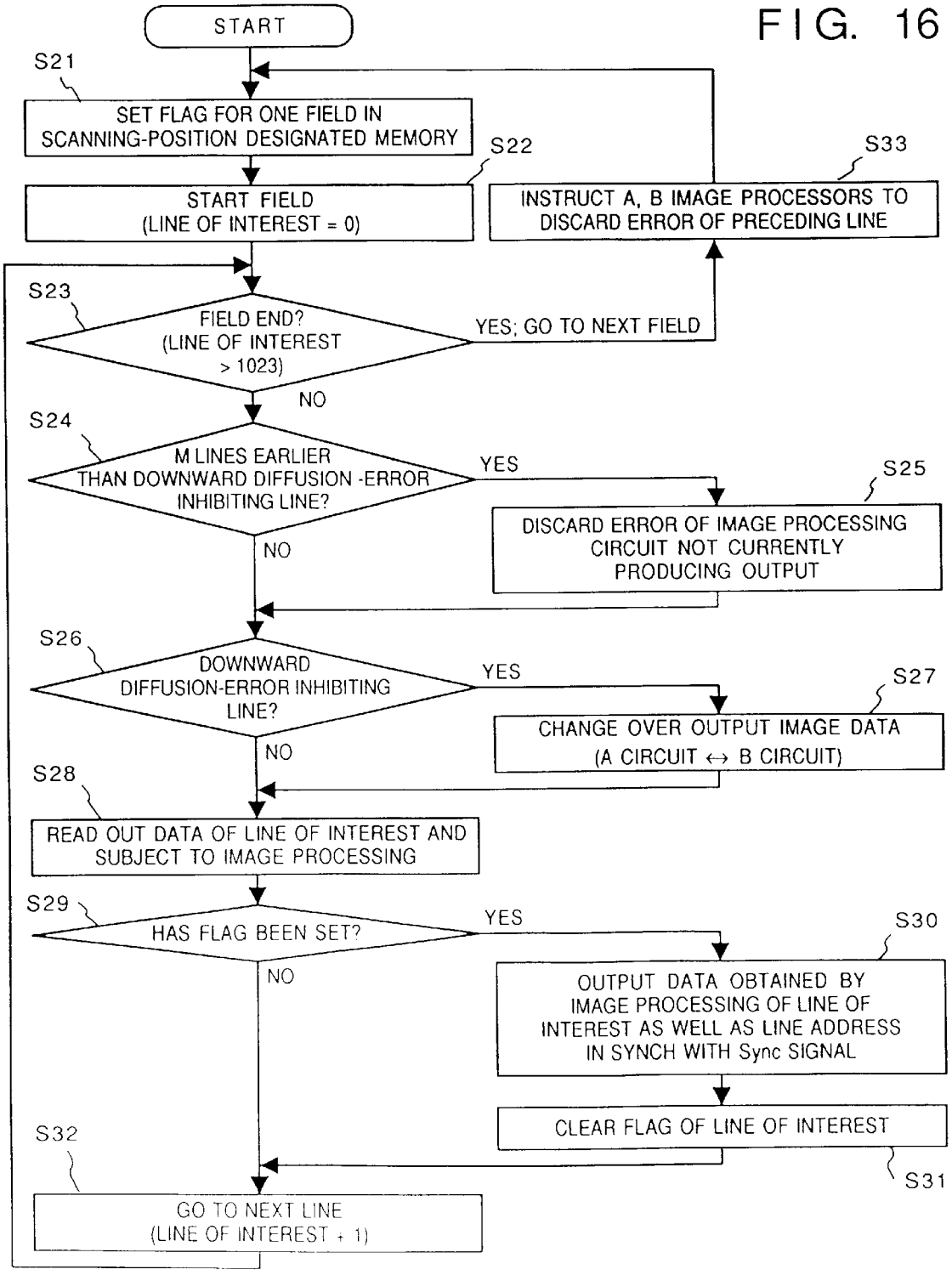
FIG. 16
START
S21
SET FLAG FOR ONE FIELD IN SCANNING-POSITION DESIGNATED MEMORY
S22
START FIELD (LINE OF INTEREST = 0)
S33
INSTRUCT A, B IMAGE PROCESSORS TO DISCARD ERROR OF PRECEDING LINE
S23
FIELD END? (LINE OF INTEREST > 1023)
YES; GO TO NEXT FIELD
NO
S24
M LINES EARLIER THAN DOWNWARD DIFFUSION -ERROR INHIBITING LINE?
YES
S25
DISCARD ERROR OF IMAGE PROCESSING CIRCUIT NOT CURRENTLY PRODUCING OUTPUT
NO
S26
DOWNWARD DIFFUSION-ERROR INHIBITING LINE?
YES
S27
CHANGE OVER OUTPUT IMAGE DATA (A CIRCUIT ↔ B CIRCUIT)
NO
S28
READ OUT DATA OF LINE OF INTEREST AND SUBJECT TO IMAGE PROCESSING
S29
HAS FLAG BEEN SET?
YES
S30
OUTPUT DATA OBTAINED BY IMAGE PROCESSING OF LINE OF INTEREST AS WELL AS LINE ADDRESS IN SYNCH WITH Sync SIGNAL
NO
CLEAR FLAG OF LINE OF INTEREST
S31
S32
GO TO NEXT LINE (LINE OF INTEREST + 1)

DISPLAY CONTROL METHOD AND APPARATUS

This application is a continuation of application Ser. No. 08/248,511, filed May 24, 1994, now abandoned.

BACKGROUND OF THE INVENTION

1. Field of the Invention

This invention relates to a display control method and apparatus and, more particularly, to a display control method and apparatus for quantizing input data to binary or multi-valued data and delivering the quantized data to a display device such as a matrix panel display.

2. Description of the Related Art

Examples of matrix panel displays according to the prior art include plasma displays, electroluminescence displays and liquid-crystal displays. Among these the liquid-crystal display is used most widely owing to its clarity and low power consumption.

One type of liquid-crystal display is a ferrodielectric liquid-crystal display (hereinafter referred to an "FLC"), in which the liquid crystal differs from other types of liquid crystal in that it exhibits a "memory" property. Specifically, the liquid crystal retains the state of a display changed by application of an electric field. In a display device using an FLC, the memory property assures that there is no decline in contrast regardless of the number of scanning lines. This makes it possible to provide a large-screen, high-definition display.

The above-mentioned FLC is an element capable of displaying only two values (two gray levels). Consequently, in order to express half tones, a technique often used is to split a pixel into a plurality of pixels. With this method, however, tones can only be expressed in a stepwise manner. This method falls far short of full-color or analog tones and is not suited to display of photographs, for example.

The dither method and error-diffusion method are known as methods of expressing full-color and analog tones from a small number of tones.

The dither method is effective in displays having a certain number of gray levels. However, in displays of two, three or four grays, a satisfactory picture quality cannot be obtained. The error-diffusion method provides better picture quality than the dither method and makes it possible to obtain a satisfactory picture quality even with a display of two grays. However, since a property of the error-diffusion method is that error is diffused to nearby pixels, processing that is continuous at all times is required. Accordingly, interlace scanning in which scanning is performed every other line cannot be carried out in a display.

With an FLC, however, a fixed period of time is needed to write one line. If the number of scanning lines is large, therefore, the frame frequency declines. In interlace scanning in which scanning is performed in regular order from the top to the bottom of the display screen, this leads to image flicker and results in a display which does not have a quick response.

In a display device using an FLC, therefore, it is necessary to use "multi-interlacing" or "partial preferential scanning". In multi-interlacing, scanning is performed while skipping a plurality of lines. In FIG. 11, for example, a display is shown in which skipping is performed every two lines. In partial preferential scanning, the scanning lines of that portion of an image that has changed from the immediately preceding frame of the image are scanned preferentially.

Accordingly, it is difficult to use image processing requiring continuous processing, such as the aforementioned error-diffusion method, in an FLC display that requires multi-interlacing or partial preferential scanning.

SUMMARY OF THE INVENTION

Accordingly, an object of the present invention is to provide an image display method and apparatus improved to eliminate the aforementioned drawbacks of the prior art.

Another object of the present invention is to provide a display control method and apparatus in which discontinuous scanning, such as interlace scanning or partial preferential scanning, is made possible using image processing that requires continuous processing such as the error-diffusion method.

A further object of the present invention is to provide a display control method and apparatus in which, when input data is quantized as by the error-diffusion method and displayed, an area in which there is no change in the display is scanned by multi-interlacing whereas an area in which there is a change in the display is scanned preferentially and in interlaced fashion, as a result of which a flicker-free image having a high picture quality can be displayed at high speed.

Yet another object of the present invention is to provide a display control method and apparatus in which error produced by the error-diffusion method is reset at a prescribed line and, at the time of the error resetting operation, error-diffusion processing is executed from a line located several lines earlier, thereby preventing the occurrence of sparkling noise and making it possible to display an image of a high picture quality in which the continuity of error-diffusion processing is maintained.

A further object of the present invention is to provide a display control method and apparatus suited to an FLC display.

Other features and advantages of the present invention will be apparent from the following description taken in conjunction with the accompanying drawings, in which like reference characters designate the same or similar parts throughout the Figures thereof.

BRIEF DESCRIPTION OF THE DRAWINGS

FIG. 16 is a flowchart illustrating a display control algorithm according to the first modification;

DESCRIPTION OF THE PREFERRED EMBODIMENT

A preferred embodiment of the invention will now be described in detail with reference to the accompanying drawings.

Figure 1:
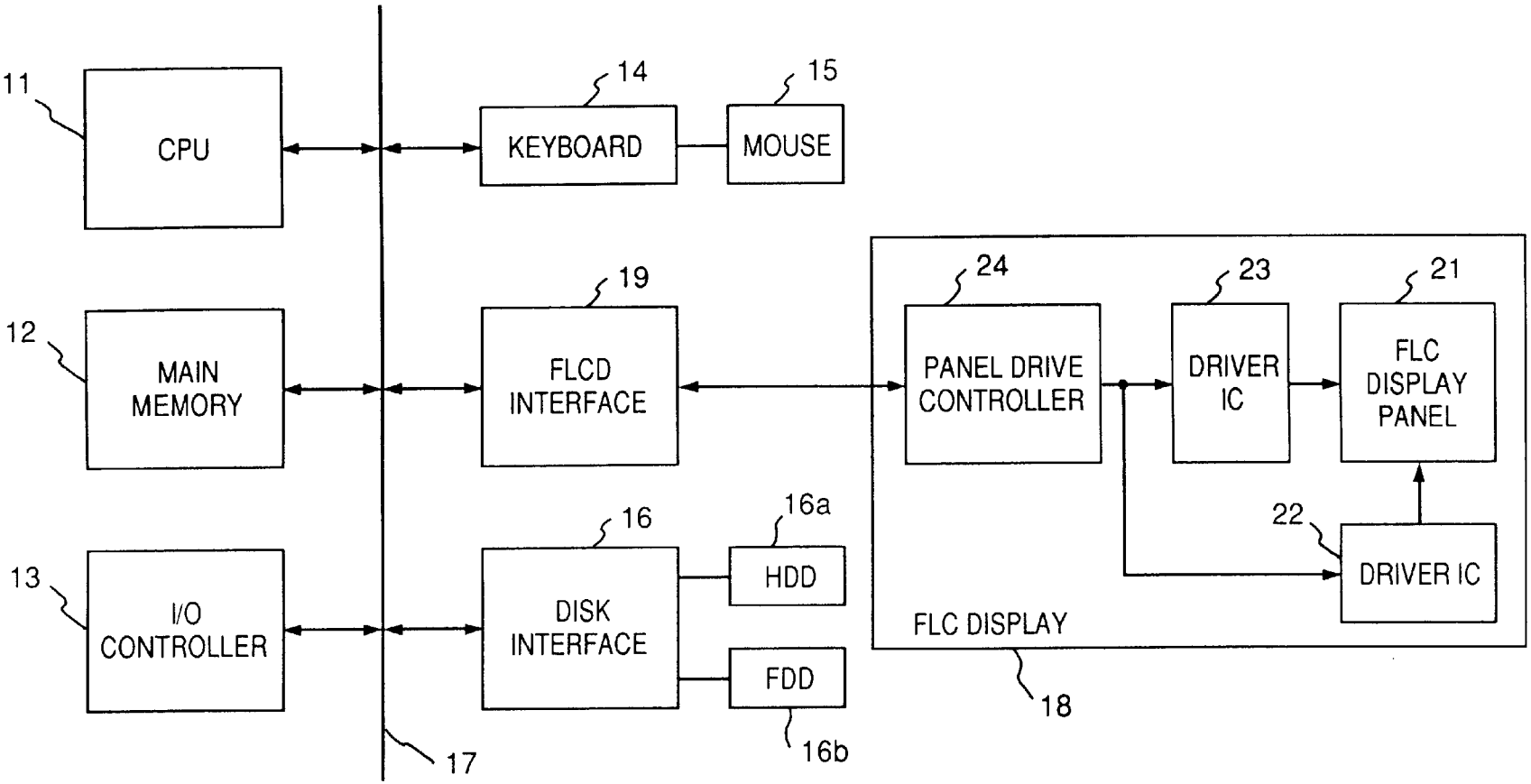
FIG. 1 is a block diagram illustrating the overall configuration of an information processing system according to an embodiment of the present invention.

FIG. 1 is a block diagram illustrating the construction of an information processing system functioning as a display control apparatus according to an embodiment of the present invention.

As shown in FIG. 1, the system includes a central processing unit (CPU) 11 for controlling the overall information processing system, a main memory 12 for storing programs and for being used as a work area when the programs are executed, an input/output control unit (I/O controller) having an interface such as the RS-232, a keyboard 14 employed by the user to enter character information and control information, a pointing device 15, a disk interface 16 for controlling a hard disk 16*a* and a floppy disk 16*b* as external storage devices, a bus system 17 comprising a data bus, a control bus and an address bus for interconnecting the signals from these components, a ferrodielectric liquid-crystal display interface (hereinafter referred to as an "FLCD interface") 19 and a ferrodielectric liquid-crystal display (hereinafter referred to as an "FLCD").

The FLCD has a display panel 21 comprising two glass plates on which electrodes have been disposed in the form of a matrix array and which have been subjected to an alignment treatment, and a ferrodielectric liquid crystal filling the space between the two glass plates. Information electrodes and scanning electrodes are connected to driver IC's 22, 23. A panel drive controller 24 is for controlling driving of the display panel 21.

As for the specifications of the FLCD in this embodiment, panel size is 15 inches and resolution is 1024 pixels vertically and 1280 pixels horizontally. Each pixel is split into sub-pixels having R, G, B and W color filters. Depending upon the combination of sub-pixels turned on, therefore, 16 colors (four bits per pixel) are capable of being displayed by one pixel.

Figure 2:
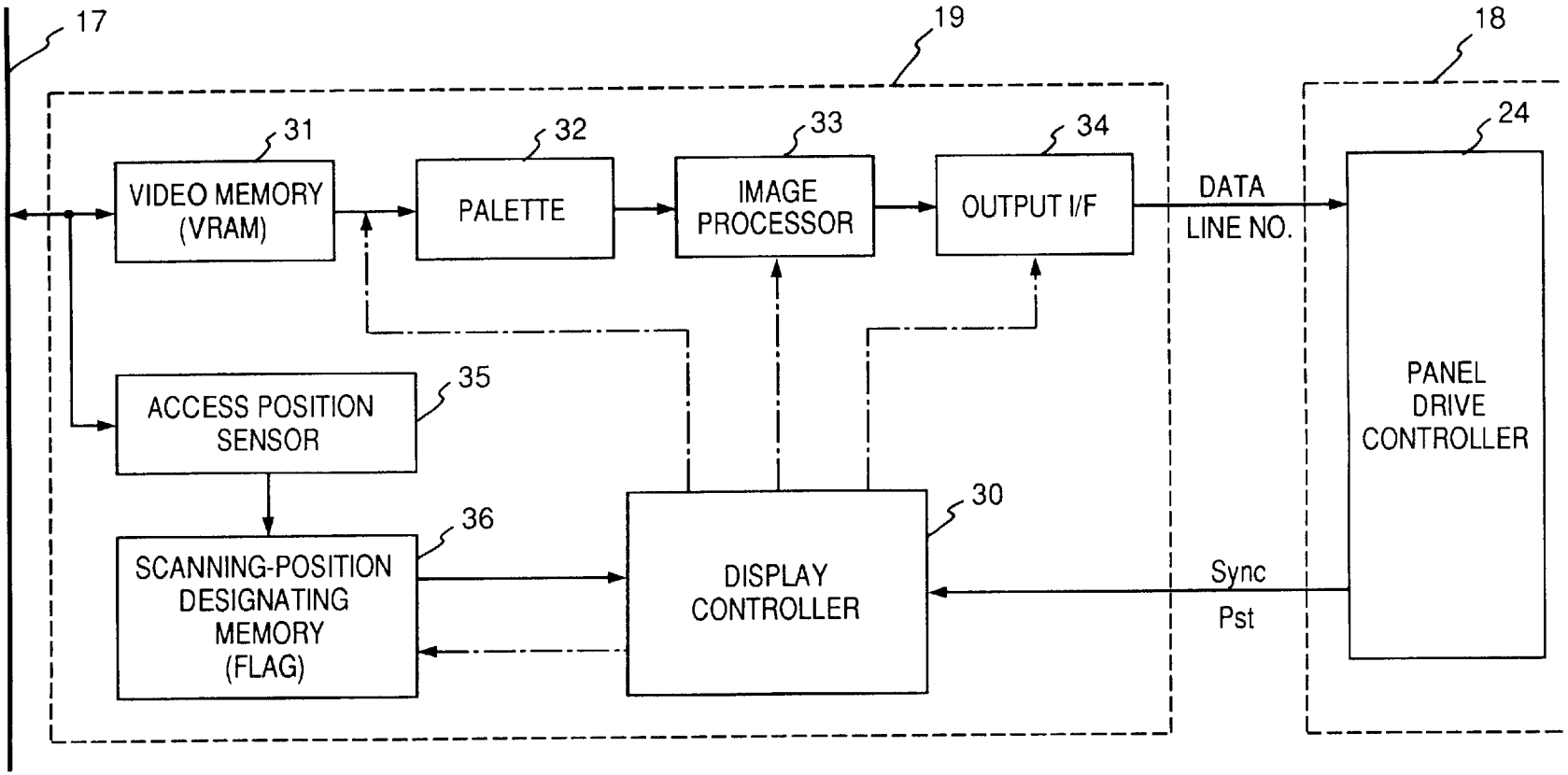
FIG. 2 is a block diagram illustrating the internal construction of an FLCD interface according to the present invention.

FIG. 2 is a block diagram illustrating the internal construction of the FLCD interface 19 shown in FIG. 1. The FLCD interface 19 includes a display controller 30 for controlling the overall FLCD interface 19. The display controller 30 is the core of control for realizing the display system in this embodiment.

The display controller 30 reads out one line of data from a video memory (VRAM) 31, which is capable of storing at least one frame of data. The data that has been read out is subjected to a color conversion by a palette 32 and then applied to an image processor 33. The data which enters the image processor 33 is eight-bit data, for each of the colors R, G, B and W per pixel. One line of display data binarized by the image processor 33 to one bit for each of the colors R, G, B and W per pixel in accordance with the error-diffusion method is applied to an output I/F 34. The latter joins the data (represented by Data in FIG. 2) to scanning-line address information (Line NO. in FIG. 2), which indicates the scanning line to be displayed. The resulting signal is transferred to the panel drive controller 24. The latter displays the arriving display data on scanning lines corresponding to the scanning-line address information.

Thus, by transferring data to which a scanning line address has been appended, the display controller 30 is capable of freely controlling scanning on the display panel.

It should be noted that the scanning speed of an FLCD is dependent upon temperature. This means that it is necessary for the synchronizing signal for data transfer to be produced on the side of the FLCD. Accordingly, the panel drive controller 24 supplies the FLCD interface 19 with a synchronizing signal (Sync in FIG. 2) for when one scanning line of data is transferred and with a panel-status signal (Pst in FIG. 2), which is a signal indicating the present scanning speed of the display panel.

An access position sensor 35 performs monitoring to determine which area in the video memory (VRAM) 31 receives a data input. As a result, it is possible to detect an area in which there has been a change in data content with respect to the immediately preceding frame. When the access position sensor 35 senses access to the video memory 31, a flag is set, at a position corresponding to the accessed area, in a scanning-position designating memory for storing the accessed area.

Figure 3:
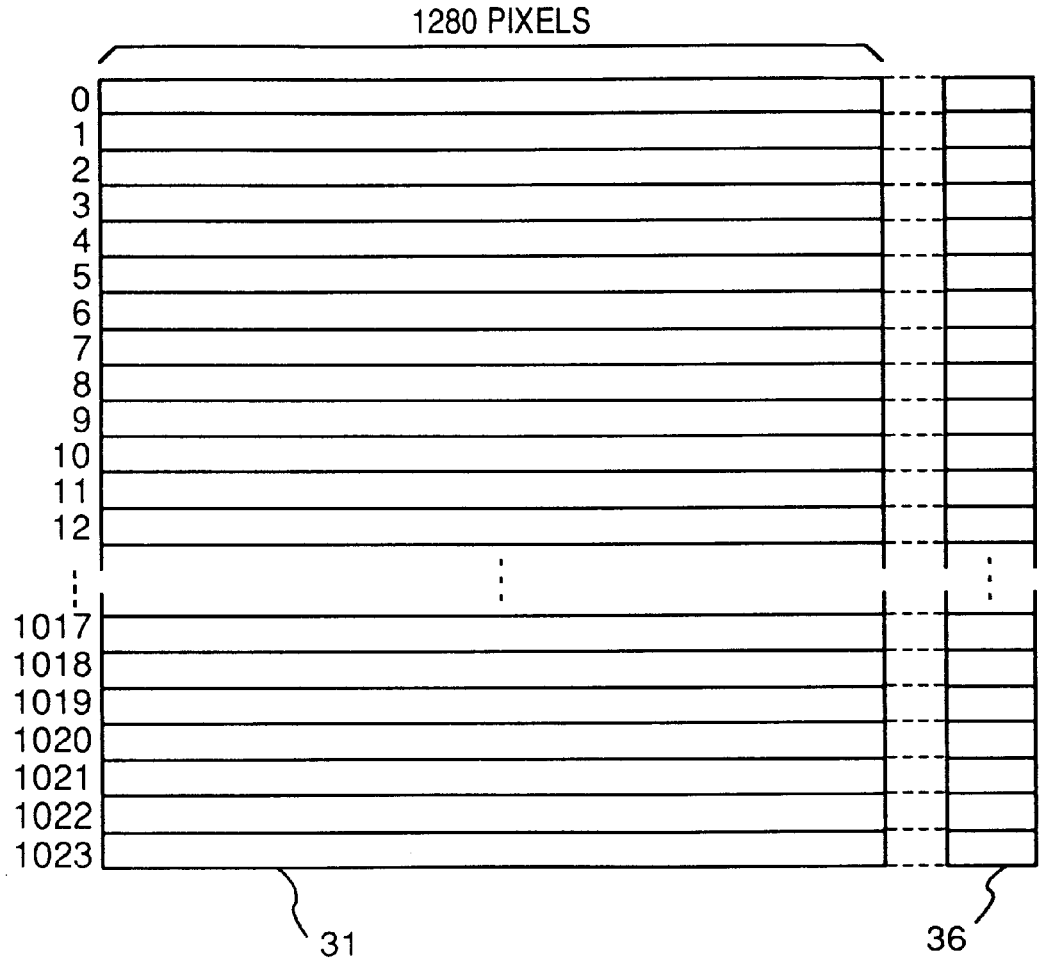
FIG. 3 is a diagram showing the relationship between a video memory and a memory for designating display position according to this embodiment.

FIG. 3 is a diagram illustrating the relationship between the video memory 31 and scanning-position designating memory 36 as data in the video memory 31 according to this embodiment. FIG. 3 illustrates the manner in which one flag register corresponds to information on one scanning line.

Upon sensing an updated area (namely an area to be scanned preferentially), the access position sensor 35 sets a flag or flags in the flag register of the line. The display controller 30 decides the display scanning line in accordance with the flag in the scanning-position designating memory 36 and transfers data to the panel drive controller 24.

In a case where the memory property of the FLC is not adequate, it is desired that all lines of one frame be scanned (refreshed) at a certain period even in the case of areas of the image that have not changed. Accordingly, the display controller 30 itself writes a flag or flags in the scanning-position designating memory 36 at the time of the refresh operation and clears flags at the conclusion of the refresh operation.

Figure 4:
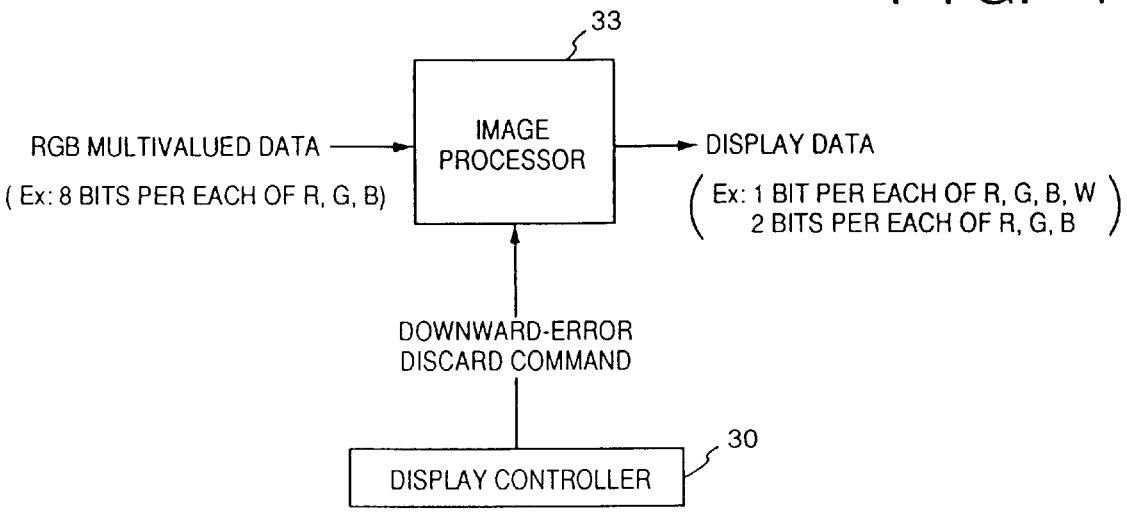
FIG. 4 is a diagram showing data input/output of an image processor according to the embodiment.

FIG. 4 is a diagram showing the input/output status of data in the image processor 33 according to the embodiment. As shown in FIG. 4, the image processor 33 applies image processing to multivalued data from the palette 32 and outputs display data conforming to the specifications of the FLCD panel. Here the input data from the palette 32 is eight-bit data for each of R, G, B, and the display data outputted to the FLCD is one-bit data for each of R, G, B, W.

Figure 5:
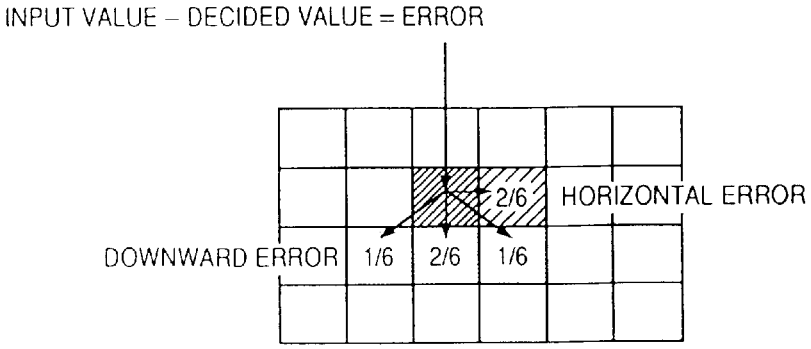
FIG. 5 is a diagram showing the error-diffusion method according to this embodiment.

FIG. 5 is a diagram showing the error-diffusion method used in image processing within the image processor 33 according to this embodiment. Here one decided value (displayable color or luminance; preferably the value is close to the input value) is selected with regard to an entered input value (color data or luminance data) of a certain pixel. An error produced between the input value and the decided value is diffused while weighting is applied to neighboring pixels not yet processed.

According to the error-diffusion method as shown in FIG. 5, error generally is diffused not only horizontally but also vertically (downward). The image processor 33 therefore has a line buffer for at least one line and is so adapted that an error resulting from processing of the preceding line can be diffused to the next line. Thus, error-diffusion processing is performed continuously in the scanning direction. After the image processing of one line, therefore, image processing of the next line (the immediately underlying line) must be executed.

In a case where the error-diffusion method is applied to display processing in a display, a problem arises that is different from that encountered in the case where this method is applied to a printer. Specifically, the error-diffusion method expresses half-tones by dispersing error to the surrounding pixels, consequently, when one portion in the image is rewritten, the pixels processed subsequently are affected significantly. This phenomenon will now be described.

Figure 6:
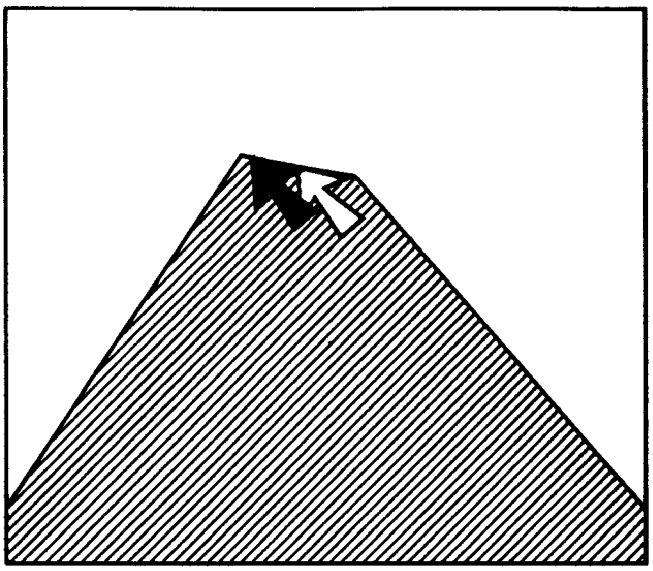
FIG. 6 is a diagram for describing a sparkling phenomenon produced by moving a mouse on a screen.

FIG. 6 is a diagram for describing a sparkling phenomenon produced by moving a pointing device on a screen. Specifically, the area indicated by the shaded portion in FIG. 6 differs according to the results of error-diffusion processing of one frame executed prior to movement of the mouse indicated by the arrows and the results of processing after movement of the mouse. In other words, there is a change in the ON/OFF combination of bits expressing half-tones. No problems arise in the case of a printer because each result of processing is outputted independently on separate sheets of paper. On a display, however, a sparkling phenomenon (in which a changing area appears to sparkle) occurs and a contrast difference appears owing to the ON/OFF change of the bits. This produces an unattractive display.

Figure 7:
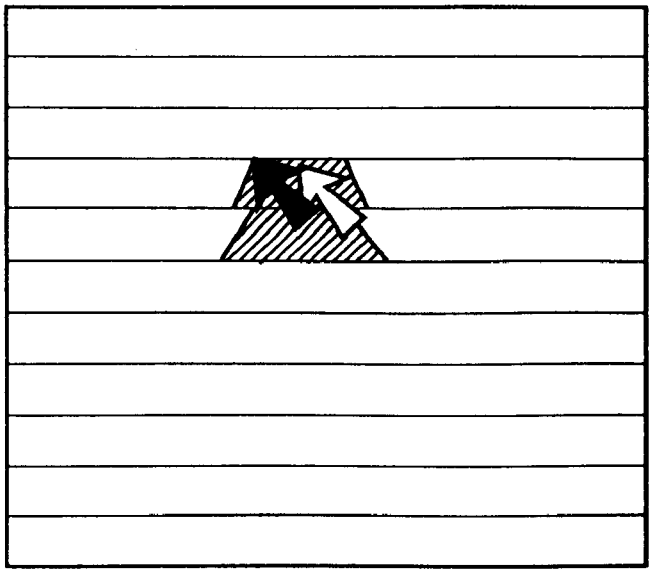
FIG. 7 is a diagram illustrating a case in which a downward error-diffusion inhibiting line according to this embodiment is provided.

Accordingly, in order to make the area in which the sparkling phenomenon occurs smaller in this embodiment, error diffusion downward from a certain determined line is inhibited, as shown in FIG. 7. To this end, the image processor 33 is provided with an error resetting function in which downward error produced on the preceding line is discarded by a command from the display controller 30 so that error diffusion to the next line is not carried out.

By virtue of this function, the spread or influence of error is halted every several lines, whereby the area in which the sparkling phenomenon occurs contracts, as indicated by the shaded portion in FIG. 7. This reduces greatly the unattractive appearance of the display.

Another problem encountered with the error-diffusion method is a deterioration in expression of half-tones at the portion of the image processed first. In a case where error-diffusion processing is executed continuously from the top to the bottom of a frame, a portion of poor half-tone expression occurs only at the upper end of the picture. The problem, therefore, is not that acute.

Figure 8:
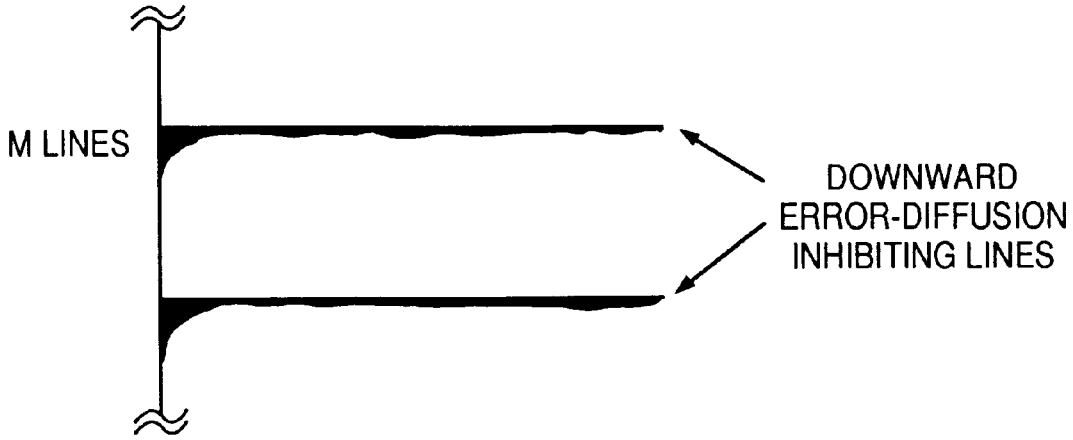
FIG. 8 is a diagram showing poor half-tone representation in the proximity of a portion at which error-diffusion processing starts.

However, when a line for inhibiting downward error diffusion is provided, as mentioned above, several lines from this line onward undergo a decline in half-tone expression (see the blackened portions in FIG. 8). The result is a marked deterioration in overall picture quality. According to the present invention, this problem is solved by executing error-diffusion processing several lines ahead of the aforementioned line at which downward error diffusion is inhibited.

Figure 9:
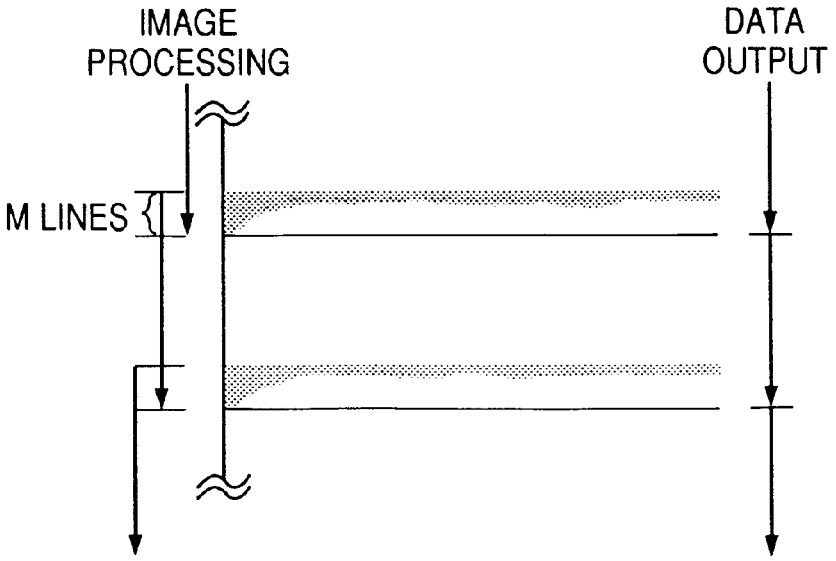
FIG. 9 is a diagram showing the manner in which image processing is executed from a line several lines ahead of the downward error-diffusion inhibiting line according to this embodiment.

FIG. 9 is a diagram showing the manner in which error-diffusion processing is executed from several lines prior to the downward error-diffusion inhibiting line. If we let M represent the number of lines of an area which undergoes a deterioration in half-tone expression, then it is so arranged that error-diffusion processing is executed at least M lines earlier.

It should be noted that the results of error-diffusion processing corresponding to M lines are not outputted. What is strictly outputted is the data of lines ahead of the downward error-diffusion inhibiting line. As a result, half-tone expression in the vicinity of the downward error-diffusion inhibiting line is improved and it is possible to prevent a decline in overall picture quality.

Figure 10:
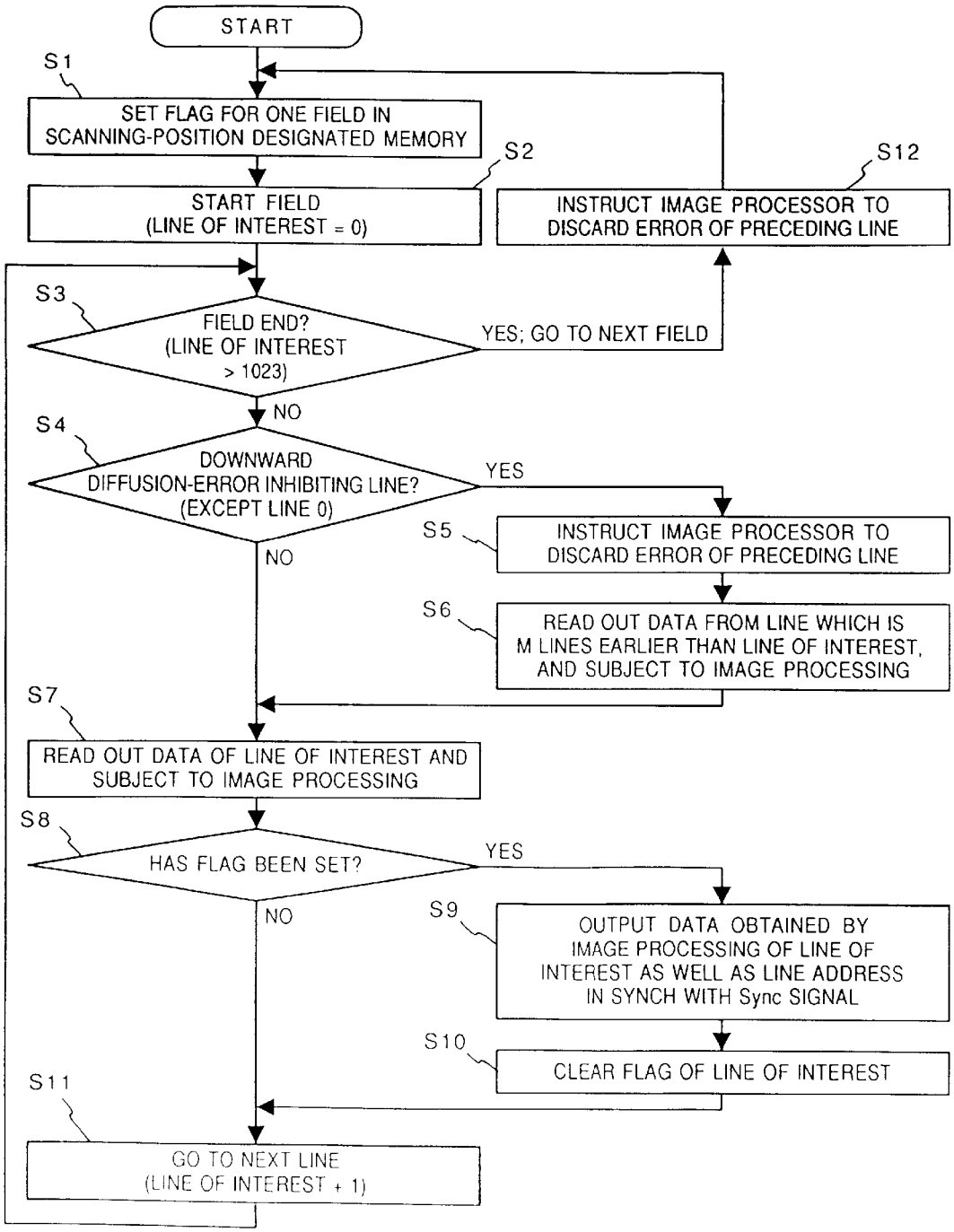
FIG. 10 is a flowchart illustrating a display control algorithm according to this embodiment.

FIG. 10 is a flowchart illustrating a display control algorithm in the display controller 30 according to this embodiment. In order to simplify the description, it will be assumed initially that the aforementioned partial preferential scanning is not executed at all.

As shown in the flowchart of FIG. 10, step S1 calls for the display controller 30 to set a flag for refreshing the next field in the scanning-position designating memory 36 at the end of the current field. Here a field is defined as what is covered by completion of scanning from the top to the bottom of an image.

In a case where refresh is performed by three-field interlacing (interlace scanning skipping two lines), the entirety of one frame can be scanned in the three fields of [(field 0) 0, 3, 6, 9, . . . /(field 1) 1, 4, 7, 10, . . . /(field 2) 2, 5, 8, 11, . . . ].

Figure 11:
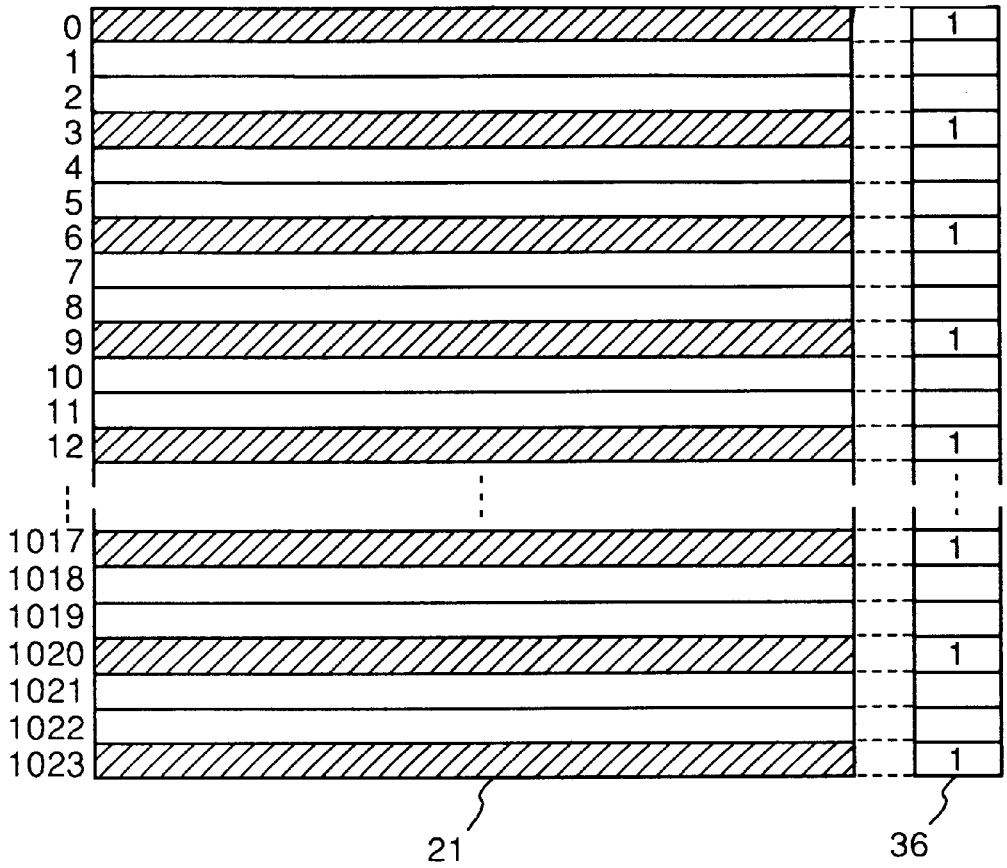
FIG. 11 is a diagram showing the manner in which a flag for multi-interlacing is set in a memory for designating scanning position, this being illustrated taking three-field interlacing as an example.

FIG. 11 illustrates the manner in which flags for performing multi-interlacing (three-field interlacing) are set in the scanning-position designating memory 36. As shown in FIG. 11, flags have been set at scanning lines (0, 3, 6, 9, . . . 1017, 1020, 1023), which are represented by the shaded areas in FIG. 11.

Accordingly, the display controller 30 starts field scanning (step S2). Since the line of interest initially is 0, decisions rendered at steps S3, S4 are both "NO" and the processing of steps S5, S6 is skipped.

The display controller 30 reads data out of the video memory 31 from the uppermost line and subjects this data to image processing at step S7. At the same time, it is determined at step S8 whether a flag has been set for this line. If a flag has not been set, then the program proceeds to processing of the next line (step S11).

In the case described above, the results of processing obtained by image processing are discarded. However, the downward error produced by this processing is retained in the image processor 33 and is used for the sake of error diffusion to the next line.

If it is found at step S8 that a flag has been set, then the results of processing obtained by the image processing of step S7 are outputted to the panel drive controller 24, together with the scanning-line address information, in synchronism with the signal Sync (step S9). After the data is outputted, the flag for this line is cleared (step S10).

If it is found at step S4 that the line of interest is the downward error-diffusion inhibiting line, then the display controller 30 instructs the image processor 33 to discard (reset) the error information of the preceding line (step S5). Image processing is then executed at step S6 in regular order from a line obtained by the following formula:

(line of interest)−M (where M is a constant; see FIG. 9)

It should be noted that the results of image processing for these M lines are not used as output data. What is outputted is strictly data for the lines, below the line of interest, for which flags have been set.

By repeating the foregoing operation, the shaded portions in FIG. 11 are outputted and scanning of field 0 of three-field interlacing is carried out. At the end of the field (where a "YES" decision is rendered at step S3), the program returns to step S1 to set the flags for the next field. For example, assume that field 1=1, 4, 7, 10, 13, . . . 1018, 1021 holds.

Now the error information retained in the image processor 33 is discarded (step S12). The reason for this is that the retained error is that which was produced by the final line (line 1023) of the preceding field, and there is no continuity with the line (line 1) about to undergo processing from this point onward.

When the foregoing operation is performed with regard to fields 0, 1 and 2, the entirety of one frame is scanned and displayed. By virtue of this method of display, error-diffusion processing is executed continuously. However, by outputting only lines for which flag have been set, interlace scanning is made possible.

Operation will now be described for a case where partial preferential scanning is carried out by aforementioned display algorithm.

Figure 12:
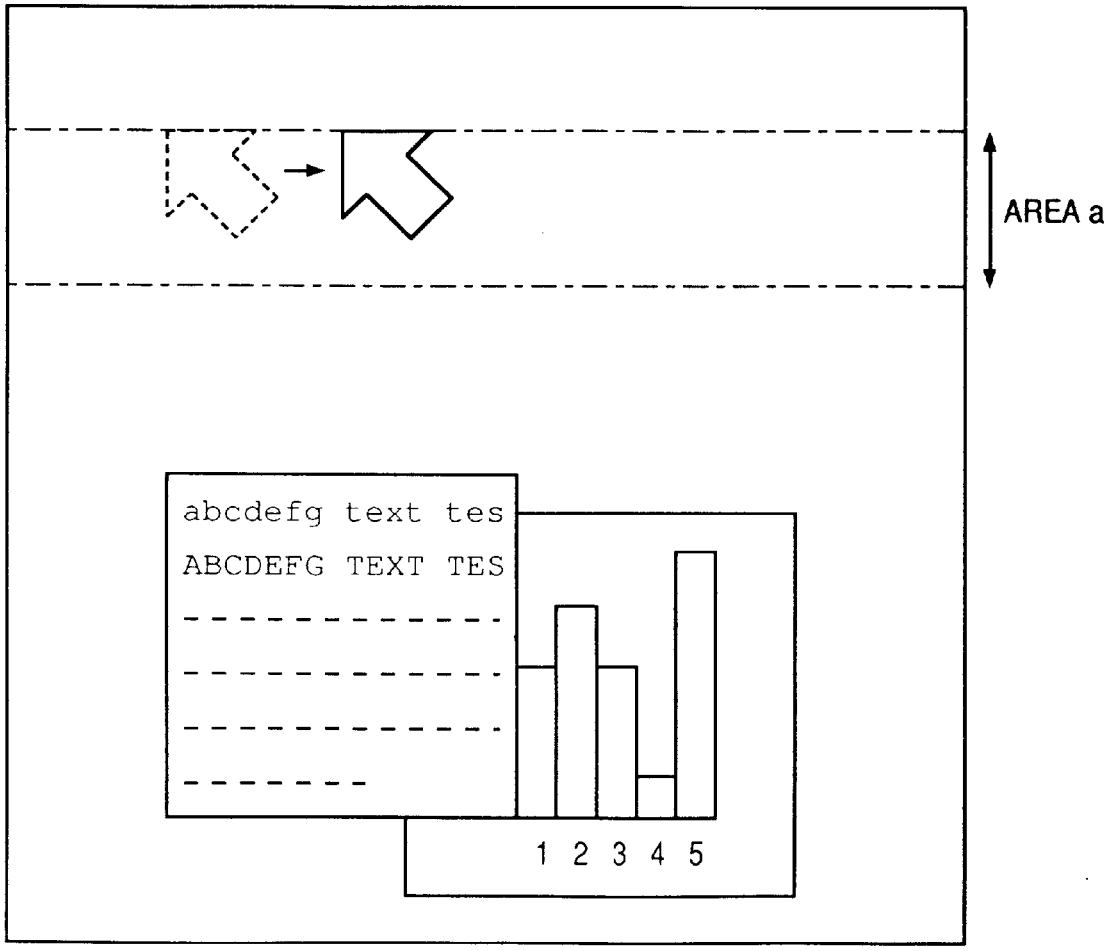
FIG. 12 is a diagram for describing operation at the time of partial rewriting, in which a mouse is moved in a window environment.

FIG. 12 is a diagram for describing operation at the time of partial rewriting, in which a pointing device is moved in a window environment. When a mouse (indicated by the arrow) is moved to update data in the video memory 31, as shown in FIG. 12, the access position sensor 35 senses the area and sets a flag or flags in the scanning-position designating memory 36 (see area a in FIG. 12).

Figure 13:
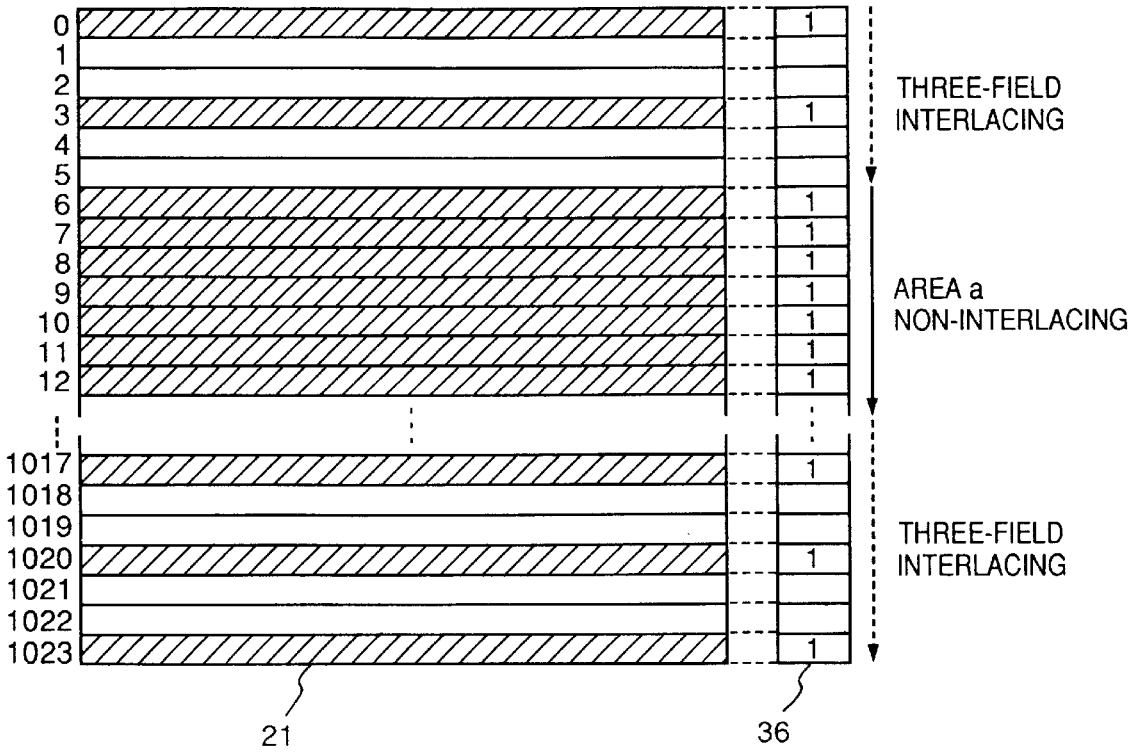
FIG. 13 is a diagram showing flags in a scanning-position designating memory for a case in which partial rewriting is requested.

FIG. 13 is a diagram showing flags, in the scanning-position designating memory 36, corresponding to the sensing of this area. The flags of lines 0, 3, 6, 9, 12 . . . 1017, 1020, 1023 shown in FIG. 13 are flags set by the display controller 30 in response to the aforementioned field end (step S1 in FIG. 10). The flags of lines 6, 7, 8, 9, 10, 11, 12 . . . are flags set (superscribed) by the access position sensor 35.

When the display data of the lines for which the flags have been set by steps S2~S11 of FIG. 10 is outputted, the lines indicated by the shaded portions in FIG. 13 are scanned in this field. In other words, three-field interlacing (interlacing skipping two lines) is carried out with regard to an area in which there is no change in the display. However, in an area which undergoes a change in display, the display is presented without interlacing (i.e., through non-interlace scanning). In comparison with other areas, therefore, this portion of the display is given a higher priority.

Thus, in accordance with the embodiment as described above, notwithstanding that special scanning which is a mixture of non-interlace scanning and interlace scanning is performed, interlace scanning and partial preferential scanning can be carried out while maintaining the continuity of error-diffusion processing at all times. As a result, rewriting of a display can be performed at high speed even with a display device having a low frame frequency, such as is the case with a ferrodielectric liquid-crystal (FLC) display.

Furthermore, in error-diffusion processing, display problems such as the sparkling phenomenon can be suppressed by inhibiting downward error diffusion over a plurality of lines.

Modifications of the foregoing embodiment will now be described.

<First Modification>

Figure 14:
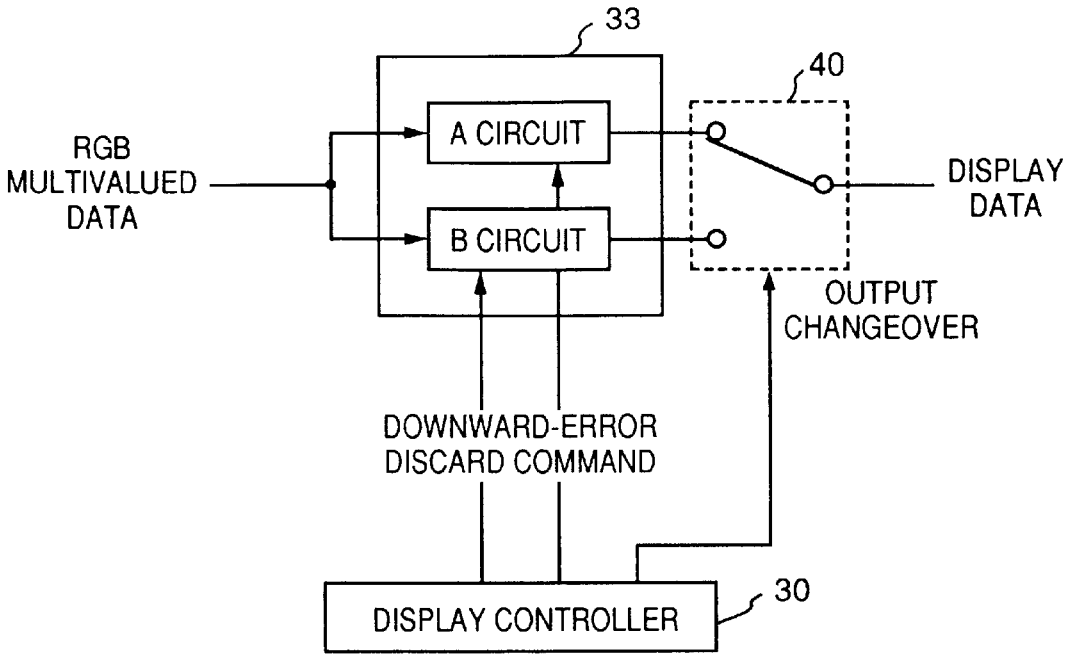
FIG. 14 is a diagram showing the construction of an image processor according to a first modification.

FIG. 14 illustrates an arrangement in which the image processor 33 constituting the information processing system in a first modification of the foregoing embodiment possesses two channels, namely an A circuit and a B circuit. As illustrated in FIG. 14, the display controller 30 controls the changeover of a switch 40 in such a manner that the output of the A circuit or B circuit is delivered as display data, and instructs the A circuit or the B circuit to discard the error of the preceding line.

Figure 15:
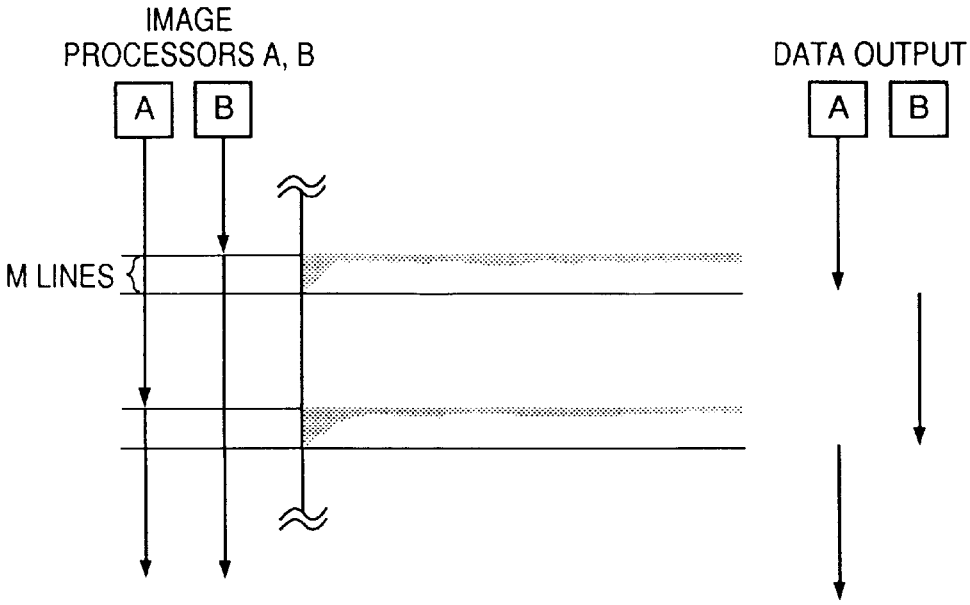
FIG. 15 is a diagram showing the construction of an image processor according to a first modification.

FIG. 15 illustrates the manner in which display data is alternately outputted from the A and B circuits in FIG. 14, as well as the timing for inhibiting downward error diffusion of each of the A and B circuits. As shown in FIG. 14, the A and B circuits both execute image processing at all times. The only difference is the timing at which the error of the preceding line is discarded.

FIG. 16 is a flowchart illustrating the operation of the display controller 30 according to this modification constructed as set forth above. In the description that follows, it is assumed that the data from the A circuit shown in FIG. 14 has been selected as the display data. Further, processing steps identical with those of the display control algorithm according to the embodiment shown in FIG. 10 are not described again.

When the line of interest reaches a line that is M (see FIG. 15) lines earlier than the next downward error-diffusion inhibiting line (namely when a "YES" decision is rendered at step S24), the error of the preceding line from the B circuit, which is the circuit of the A and B circuits not currently producing an output (the circuit currently outputting a signal is the A circuit, as mentioned above), is discarded (step S25).

When the line of interest reaches the downward error-diffusion inhibiting line (namely when a "YES" decision is rendered at step S26), the output image data is changed over at step S27 and the output from the B circuit is made the display data.

Image processing of the line of interest is executed at step S28. If it is then determined at step S29 that a flag has been set, the results of processing from the B circuit are outputted in synchronism with the Sync signal (step S30).

Effects similar to those of the foregoing embodiment are obtained even if an arrangement is adopted in which the above-described operation is repeated to interchange the A and B circuits in regular order.

<Second Modification>

A system configuration will now be described as a second modification of the foregoing embodiment particularly for a case where a color display is presented.

Figure 17:
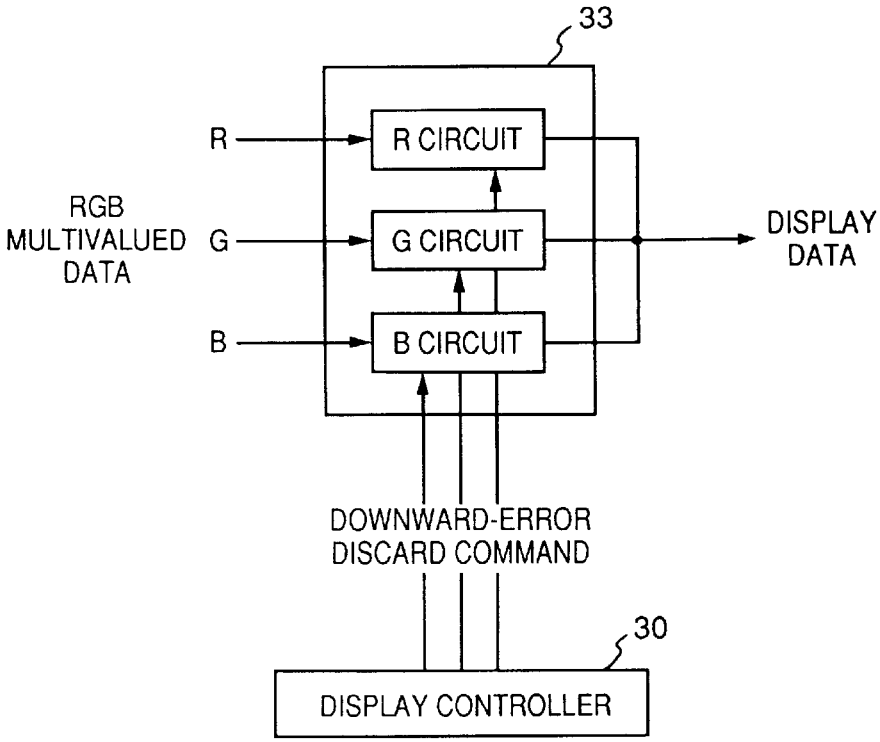
FIG. 17 is a diagram showing the construction of an image processor according to a second modification.

FIG. 17 is a diagram a modification in which the image processor 33, which constitutes the information processing system according to this modification, comprises three circuits (an R circuit, a G circuit and a B circuit) for the colors R, G, B. Each circuit is so adapted as to be provided independently with a command from the display controller 30 for discharging the error of the preceding line. Further, according to this modification, the downward error-diffusion inhibiting lines for the respective colors R, G, B are successively offset a slight amount.

Figure 18:
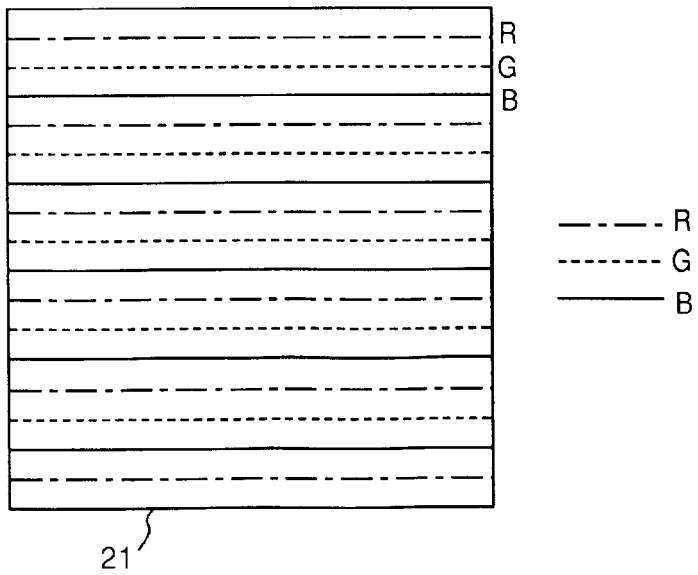
FIG. 18 is a diagram showing the manner in which the downward error-diffusion inhibiting line is shifted for each of the colors R, G, B in the second modification.

FIG. 18 illustrates the manner in which the downward error-diffusion inhibiting lines for the respective colors R, G, B are successively offset. As a result of this arrangement, the positions of the areas in which there is poor expression of half-tones differ for each of the colors R, G, B. This renders the deterioration in picture quality less conspicuous overall.

In the above-described arrangement, error-diffusion processing need not be performed several lines in advance of the downward error-diffusion inhibiting line. Nevertheless, similar effects can be obtained.

In the foregoing embodiment and modifications, movement of a cursor under the control of a pointing device is described as an example of a painting event. However, it goes without saying that this does not impose a limitation upon the painting event.

Figure 19:
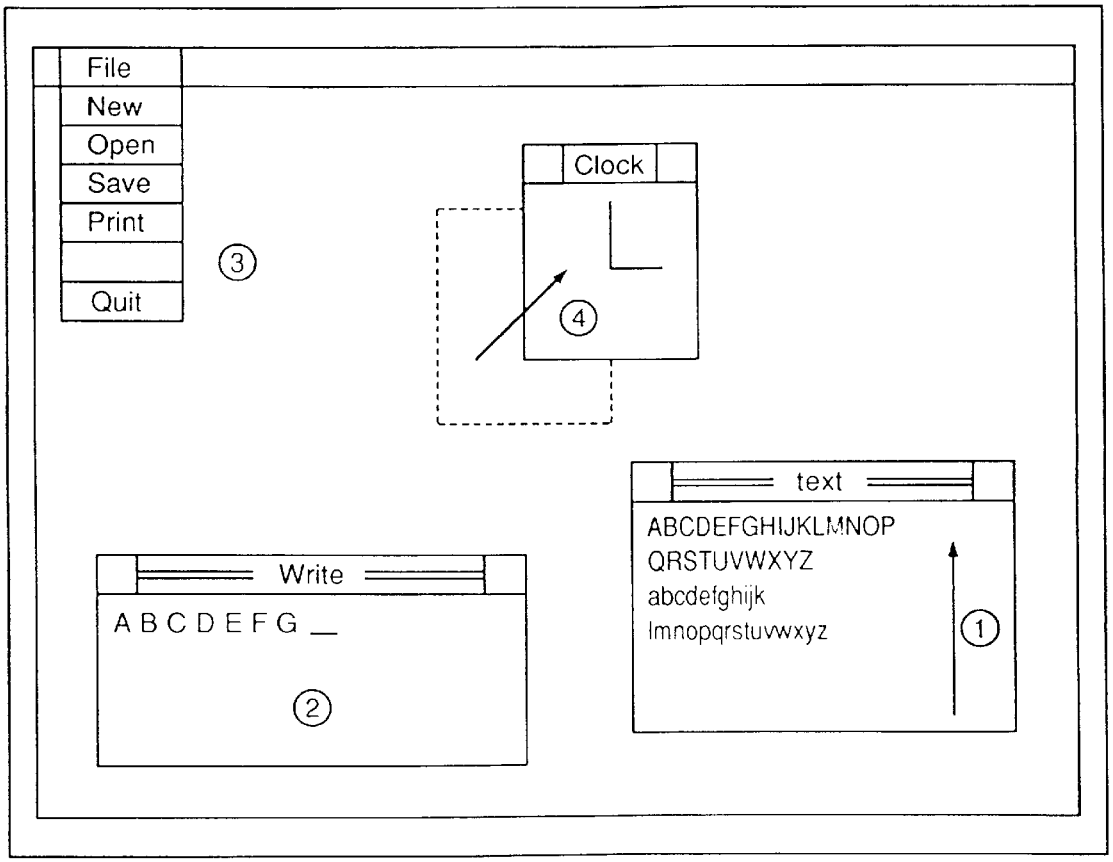
FIG. 19 is a diagram showing an example of a painting event other than that performed by a mouse.

FIG. 19 illustrates examples of other painting events using means other than a mouse. In FIG. 19, ①~④ indicate the following painting events:

① scrolling of a text display;

② a text display that accompanies a key entry;

③ a pop-up menu display; and

④ movement of a window.

In the foregoing embodiment, refresh is described taking three-field interlacing as an example. However, regardless of the number of lines skipped in interlacing, there is no effect upon the essential nature of the present invention. Furthermore, the foregoing embodiment describes only a case in which scanning proceeds from the top to the bottom (line 0→line 1023) of the image. However, scanning may proceed from the bottom to the top (line 1023→line 0) of the image.

The example of the FLCD panel described is a color panel in which one pixel is RGBW (four bits per pixel). However, the essential nature of the present invention is unchanged even if one pixel is two bits for each of RGB (six bits per pixel) or the FLCD panel is a monochromatic FLCD panel in which one pixel is one bit or two bits.

The present invention can be applied to a system constituted by a plurality of devices or to an apparatus comprising a single device. Furthermore, it goes without saying that the invention is applicable also to a case where the object of the invention is attained by supplying a program to a system or apparatus.

Thus, in accordance with the embodiment described above, when input data is quantized as by the error-diffusion method and displayed, an area in which there is no change in the display can be scanned by multi-interlacing whereas an area in which there is a change in the display can be scanned preferentially and in interlaced fashion. As a result, a flicker-free image having a high picture quality can be displayed at high speed.

Further, according to the illustrated embodiment, error produced by the error-diffusion method is reset at a prescribed line and, at the time of the error resetting operation, error-diffusion processing is executed from a line located several lines earlier, thereby preventing the occurrence of sparkling noise and making it possible to display an image of a high picture quality in which the continuity of error-diffusion processing is maintained.

As many apparently widely different embodiments of the present invention can be made without departing from the spirit and scope thereof, it is to be understood that the invention is not limited to the specific embodiments thereof except as defined in the appended claims.

What is claimed is:

1. An image display apparatus comprising:

input means for entering image data;

quantizing means for quantizing the entered image data by quantizing input data while correcting an error between input data and output data; and display means for displaying an image based upon the quantized data from said quantizing means, with said display means displaying the image by scanning a specific area by non-interlacing and scanning other areas by interlacing, wherein said quantizing means performs quantization, starting while correcting the error from the entered image data for a preceding area located a plurality of lines before the specific area without storing error data of the preceding area in a memory, when said display means scans the specific area by the non-interlacing, and wherein said quantizing means outputs the quantized data in the specific area without outputting the quantized data in the preceding area.

2. The apparatus according to claim 1, further comprising memory means for storing at least one frame of image data, wherein said input means enters the image data from said memory means in line units.

3. The apparatus according to claim 1, wherein said quantizing means binarizes the input image data to binary data by the error-diffusion method.

4. The apparatus according to claim 1, further comprising detecting means for detecting an area in which data has changed from data of an immediately preceding frame.

5. The apparatus according to claim 4, wherein said display means scans the area, which has been detected by said detecting means, as the specific area by non-interlacing.

6. The apparatus according to claim 5, wherein said display means displays the area, which has been detected by said detecting means, preferentially at a priority higher than that of other areas.

7. An image display apparatus comprising:

input means for entering image data;

quantizing means for quantizing the entered image data by quantizing input data while correcting an error between input data and output data, with said quantizing means correcting the error by diffusing the error in the line direction and resetting correction of the error at a prescribed line;

display means for displaying an image based upon the quantized data from said quantizing means, wherein when correction of the error has been reset and a succeeding line is processed, said quantizing means starts processing from a line located a plurality of lines before the succeeding line without storing error data of the line in a memory, wherein said quantizing means outputs the quantized data from the succeeding line without outputting the quantized data before the succeeding line.

8. The apparatus according to claim 7, wherein said input means enters image data of a plurality of colors, and wherein said quantizing means corrects the error by diffusing the error in the line direction and resets correction of the error at every prescribed line in a screen, with the prescribed line being different for every color of the plurality of colors.

9. The apparatus according to claim 7, further comprising memory means for storing at least one frame of image data, wherein said input means enters the image data from said memory means in line units.

10. The apparatus according to claim 7, wherein said quantizing means biparizes the input image data to binary data by the error-diffusion method.

11. The apparatus according to claim 7, further comprising detecting means for detecting an area in which data has changed from data of an immediately preceding frame.

12. The apparatus according to claim 10, wherein said display means scans the area, which has been detected by said detecting means, as the specific area by non-interlacing.

13. The apparatus according to claim 11, wherein said display means displays the area, which has been detected by said detecting means, preferentially at a priority higher than that of other areas.

14. An image display method comprising the steps of:

entering image data;

quantizing the entered image data by quantizing input data while correcting an error between input data and output data; and displaying an image based upon the quantized data from the quantizing step, with the image being displayed by scanning a specific area by non-interlacing and scanning other areas by interlacing, wherein the quantizing step performs quantization, starting while correcting the error from the entered image data for a preceding area located a plurality of lines before the specific area without storing error data of the preceding area in a memory, when the specific area is scanned by the non-interlacing, and wherein said quantizing step outputs the quantized data in the specific area without outputting the quantized data in the preceding area.

15. The method according to claim 14, wherein the quantizing step binarizes the input image data to binary data by the error-diffusion method.

16. The method according to claim 14, further comprising the step of detecting an area in which data has changed from data of an immediately preceding frame.

17. The method according to claim 16, further comprising the step of scanning the area, which has been detected in the detecting step, as the specific area by non-interlacing.

18. The method according to claim 17, wherein the area, which has been detected in the detecting step, is preferentially displayed at a priority higher than that of other areas.

19. An image display method comprising the steps of:

entering image data;

quantizing the entered image data by quantizing input data while correcting an error between input data and output data, with the error being corrected by diffusing the error in the line direction and resetting correction of the error at a prescribed line; and displaying an image based upon the quantized data from the quantizing step, wherein when correction of the error has been reset and a succeeding line is processed, the quantizing step starts processing from a line located a plurality of lines before the succeeding line without storing error data of the line in a memory, wherein said quantizing step outputs the quantized data from the succeeding line without outputting the quantized data in front of the succeeding line.

20. The method according to claim 19, wherein said entering step enters image data of a plurality of colors, and said quantizing step corrects the error by diffusing the error in the line direction and resets correction of the error at every prescribed line in a screen, with the prescribed line being different for every color of the plurality of colors.

* * * * *

UNITED STATES PATENT AND TRADEMARK OFFICE

CERTIFICATE OF CORRECTION

PATENT NO. : 6,100,872
DATED : August 8, 2000
INVENTOR(S) : Shuntaro Aratani, et al.

It is certified that error appears in the above-identified patent and that said Letters Patent is hereby corrected as shown below:

Column 5,
Line 29, "pixels, consequently," should read -- pixels. Consequently, --.

Column 10,
Line 60, "biparizes" should read -- binarizes --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*